US008342097B1

(12) United States Patent
Widder et al.

(10) Patent No.: US 8,342,097 B1
(45) Date of Patent: Jan. 1, 2013

(54) CASELESS PROJECTILE AND LAUNCHING SYSTEM

(75) Inventors: Jeffrey M. Widder, Bel Air, MD (US); Christopher A. Perhala, Dublin, OH (US)

(73) Assignee: Battelle Memorial Institute, Columbus, OH (US)

( * ) Notice: Subject to any disclaimer, the term of this patent is extended or adjusted under 35 U.S.C. 154(b) by 96 days.

(21) Appl. No.: 12/939,785

(22) Filed: Nov. 4, 2010

Related U.S. Application Data

(60) Provisional application No. 61/258,068, filed on Nov. 4, 2009.

(51) Int. Cl.
*F42B 15/00* (2006.01)
*F42B 12/00* (2006.01)

(52) U.S. Cl. ..... 102/501; 102/502; 102/517; 102/440; 102/439; 102/374; 102/431

(58) Field of Classification Search ..... 102/372, 102/374, 430, 431, 432, 439, 444, 482, 483, 102/501, 502, 503, 517
See application file for complete search history.

(56) References Cited

U.S. PATENT DOCUMENTS 3,212,402 A * 10/1965 Biehl et al. ..... 89/1.801
3,369,534 A * 2/1968 Crosman ..... 124/26
3,563,177 A * 2/1971 Ritchey ..... 102/431
4,593,620 A 6/1986 Pettersson et al.
4,907,511 A * 3/1990 Bulman ..... 102/440
4,964,341 A * 10/1990 Hebert ..... 102/501
5,097,614 A 3/1992 Strong
5,852,253 A * 12/1998 Baricos et al. ..... 89/1.41
5,992,291 A 11/1999 Widder et al.
6,065,384 A 5/2000 Widder et al.
6,131,515 A 10/2000 Cook et al.
6,134,823 A 10/2000 Griffin
6,142,058 A 11/2000 Mayville et al.
6,324,983 B1 12/2001 Dindl
6,446,535 B1 9/2002 Sanford et al.
6,532,947 B1 3/2003 Rosa et al.
6,688,032 B1 2/2004 Gonzalez et al.
6,782,828 B2 * 8/2004 Widener ..... 102/502
(Continued)

FOREIGN PATENT DOCUMENTS

CH 498361 10/1970

OTHER PUBLICATIONS

Bir et al., "*Design and Injury, Assessment Criteria for Blunt Ballistic Impacts*", The Journal of Trauma Injury, Infection, and Critical Care, vol. 57, No. 6, pp. 1218-1224, Dec. 2004.

(Continued)

*Primary Examiner* — James Bergin
(74) *Attorney, Agent, or Firm* — Diederiks & Whitelaw, PLC

(57) ABSTRACT

A launcher system includes a launcher having a barrel adapted to receive a projectile with a charge of propellant and a magazine adapted to hold additional projectiles, with each projectile including a piston shiftably mounted for movement relative to a main body. When propellant in the projectile is ignited, either mechanically or electrically, the propellant forces the piston from a retracted position during a period of initial thrust and then the propellant exits through at least one vent hole to provide an additional thrust for the projectile upon the piston moving to a fully extended position and safely discharge pressure from within the projectile. The projectile may be fired at lethal or non-lethal velocities.

25 Claims, 8 Drawing Sheets

U.S. PATENT DOCUMENTS

| | | | | |
|---|---|---|---|---|
| 7,021,219 | B1 | 4/2006 | Dindl | |
| 7,694,619 | B2 | 4/2010 | Beretta | |
| 7,823,510 | B1 * | 11/2010 | Hobart et al. | 102/490 |
| 8,056,480 | B2 * | 11/2011 | Brydges-Price | 102/502 |

OTHER PUBLICATIONS

Bir et al, "*Skin Penetration Assessment ialf Less Lethal Kinetic Energy Munitions*", Journal of Forensic Science, vol. 50, No. 6, pp. 1426-1429, Nov. 2005.

DiMaio et al., "*Minimal Velocities Necessary for Perforation of Skin by Air Gun Pellets and Bullets*", Journal of Forensic Science, vol. 27, No. 4, pp. 894-898, 1982.

Sturdivan et al., "*Analysis of Injury Criteria to Assess Chest and Abdominal Injury Risks in Blunt and Ballistic Impacts*", The Journal of Trauma Injury, Infection, and Critical Care, vol. 56, No. 3, pp. 651-663, Mar. 2004.

http://web.archive.or/web/20050310041630/http://www.angelfire.com/art/enchanter/DGL.html, Mar. 2005.

* cited by examiner

CASELESS PROJECTILE AND LAUNCHING SYSTEM

CROSS-REFERENCE TO RELATED APPLICATIONS

This application claims the benefit of U.S. Provisional Patent Application Ser. No. 61/258,068, filed Nov. 4, 2009 entitled "Careless Projectile and Launching System" and incorporated herein by reference.

BACKGROUND OF THE INVENTION

1. Field of the Invention

The present invention pertains to the field of weaponry and, more particularly, to a caseless projectile and an associated launching system used for both non-lethal and lethal applications.

2. Discussion of the Prior Art

In general, most firearms or weapons have employed bullets, which are typically fired through a relatively heavy barrel. Usually a cartridge including a bullet, a casing and smokeless propellant located in the casing is employed. Conventional hand carried weapons are typically fired by pulling a trigger which allows a movable firing pin to impact the aft end of the bullet cartridge to initiate a primer and ignite the smokeless propellant located in the bullet cartridge such that the bullet is fired out the barrel. When the firearm is fired, the bullet will have an initial high acceleration caused by high temperature and pressure of gases that propel the bullet through the barrel. Typically, the high temperature and high pressure gases are formed by the ignition of the smokeless propellant and since the deflagration of the propellant releases large amounts of energy and heat, the weapon has to be made of a very heavy durable material, usually metal. The disadvantage of such construction is that the barrel is extremely heavy and is not really suitable for light-weight non-lethal applications.

In order to provide non-lethal systems, some weapons have been designed to fire multiple frangible projectiles, often launched using air from compressed air bottles. Typically, extra air bottles and a compressor to refill empty bottles are required for sustained operations and the whole arrangement tends to be relatively heavy, while requiring a high logistic burden. Other non-lethal systems typically use a blunt, relatively large projectile that is cumbersome to transport and fire. In certain cases, non-lethal projectiles are designed to be used with launchers built for lethal ammunition. For instance, manually operated shotguns can be used to fire non-lethal ballistics such as beanbags and rubber projectiles, and non-lethal grenades from a muzzle-mounted launcher. However, such arrangements typically lack accuracy and cannot be switched to lethal fire in an efficient manner.

The most advanced prior art blunt impact projectiles are considered to be propelled either by standard style gun propellants or compressed gas. Compressed gas guns utilize a cylinder of compressed air or a gas such as carbon dioxide to propel the projectile and operate the action of the launcher so that multiple rapid follow-up shots can be achieved. Compressed gas launchers can have an advantage of rapid semi-automatic fire at the expense of a large amount of logistics associated with the transport and filling of compressed air tanks needed to operate the launcher. Certainly, solid propellant driven non-lethal weapons have an advantage of decreased logistical burdens. However, they are often not capable of the same fire rate as the compressed air guns because the weapon has to be operated manually to reload for successive shots. In general, solid propellant driven non-lethal ammunition lacks the energy to reliably operate an automatic or semi-automatic reloading mechanism of a weapon designed to fire high-pressure ammunition. This deficiency can be overcome, at least to some extent, by the use of telescoping casings, if the action is of a straight blow back design, as has been done for certain grenade launchers. However, these known launchers employ projectiles which are both expensive and large, thereby requiring a large volume for ammunition storage and greatly reducing the readiness of the launcher for lethal applications.

In general, the use of non-lethal ammunition in weapons that are otherwise used to fire lethal ammunition compromises the safety of the user by decreasing the readiness to respond with lethal force when necessary. Therefore, as can be seen from the above discussion, there is considered to be a need in the art for a non-lethal weapon that is compact and can achieve a high rate of fire without large logistical burdens, such as those associated with compressed gas guns which have gas bottles that need to be supplied and/or filled. In addition, there is a need for a weapon that is mechanically simpler, smaller and lighter than prior art compressed air or gas non-lethal weapons. Furthermore, there is a need in the art for a launcher which is small enough and light enough to mount under or to the side of the barrel of a known lethal weapon, such as an M16 rifle, without degrading the readiness or lethal performance of the rifle. Finally, there is a need in the art to provide ammunition in the form of projectiles which can be in either non-lethal or lethal form yet still be fired from the same launcher.

SUMMARY OF THE INVENTION

In general, the present invention includes a captive piston driven rocket assisted projectile and a lightweight magazine fed launcher that has a small number of moving parts relative to prior art designs. Essentially, there are two embodiments for the launcher, with one embodiment having the projectile's propellant ignited mechanically and the other embodiment having the propellant ignited electrically. In each embodiment, the launcher includes a barrel adapted to receive the projectile and a trigger that activates the projectile. A bracket is attached to the barrel for allowing the launcher to be attached to a conventional rifle or carbine. Preferably, the barrel is made from lightweight plastic with a thin rifled steel liner, and a magazine is provided for storing additional projectiles to be supplied to the barrel.

The projectile includes an outer body with a central bore, a front wall and a rear wall. A central piston hole is located in the rear wall and aligned with the central bore. At least one radially positioned vent hole is located in the rear wall near the central piston hole. A piston is slidably mounted in the bore and adapted to shift from a retracted position near the front wall to an extended position wherein the piston extends through the piston hole and projects partially out of the outer body. A retainer is mounted in the outer body or integrally formed therewith for retaining the piston within the bore. Gas-generating solid propellant is mounted in the bore near the front wall. Preferably, the propellant is shaped into a cylinder and mounted in the central bore so that the piston slides within the cylinder or the propellant is a powder that is packed into the cylinder bore in front of the piston and the primer is located between the piston head and propellant. With this arrangement, when a trigger is pulled, the projectile is activated by igniting the propellant and pushing the piston along the bore through the piston hole so the piston pushes against the launcher while the piston moves from the retracted position to the extended position to provide an initial thrust while the piston is in the bore. The propellant gasses then exit the bore through the at least one radially positioned vent hole to provide an additional thrust for the projectile when the projectile exits the bore. Preferably, three vent holes are equally spaced around the central piston hole. The outer body is made from an injection moldable material with steel or aluminum inserts. The outer body has either a uniform cross-section or each of the front wall of the outer body and the rear wall of the outer body has a larger circular cross section than the outer circular cross section of a central portion of the outer body.

In the mechanically initiated embodiment, the launching system is used by placing a projectile in the launcher and then initiating the propellant located in the projectile. Initiating the propellant includes striking the projectile with a trigger activated hammer. The hammer hits the front wall of the projectile to cause the primer located in the ogive to impact a protrusion on the piston head. The impact initiates the priming compound that ignites the propellant. When the propellant is ignited, the propellant burns or decomposes into gas, forcing the piston to extend from the projectile and push against the launcher thus propelling the projectile from the launcher. More specifically, the propellant pushes the piston head and ogive apart. As they move apart, the piston is forced against the breech face, which results in the projectile body moving towards the muzzle. Relative to the projectile body, the piston shifts along the bore from the retracted position through the piston hole to the extended position to provide an initial thrust while the piston is in the bore and then the propellant exits the bore through at least one vent hole to provide an additional thrust for the projectile. Propellant gas is vented out of the projectile through at least one vent hole after the projectile leaves the launcher to provide additional thrust for the projectile and to safely discharge pressure from within the projectile. Preferably, multiple vent holes are used which are equally spaced around the base of the projectile to balance the thrust forces from each vent to maintain a stable flight of the projectile.

In the electronically initiated embodiment, the projectile forms a circuit with the launcher and is actuated by the trigger. Specifically, the circuit travels through a capacitor and also through a priming compound located in a primer or a reactive semiconductor bridge next to the propellant. When the capacitor discharges in response to movement of the trigger, a current is sent through the circuit so that the current ignites the priming compound or causes the reactive semiconductor bridge to create plasma, thereby directly initiating the propellant.

In accordance with either embodiment of the invention, the launching system may be used with projectiles specifically made to be non-lethal or lethal. In each case, the propellant preferably accelerates the projectile both in the barrel and after leaving the barrel. However, the manner of acceleration and the final velocity in each case differs. In the non-lethal projectile, the propellant is present in an amount for preferably accelerating the projectile in the barrel to less than 300 feet per second and the front wall of the outer body is compliant and in the shape of a blunt dome so that the projectile impacts a target with non-lethal force. In the lethal projectile, the propellant is present in an amount for primarily accelerating the projectile after it leaves the barrel to greater than 800 feet per second and the front wall is not compliant with a sharp ogive so that the projectile is able to impact a target with deadly force.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
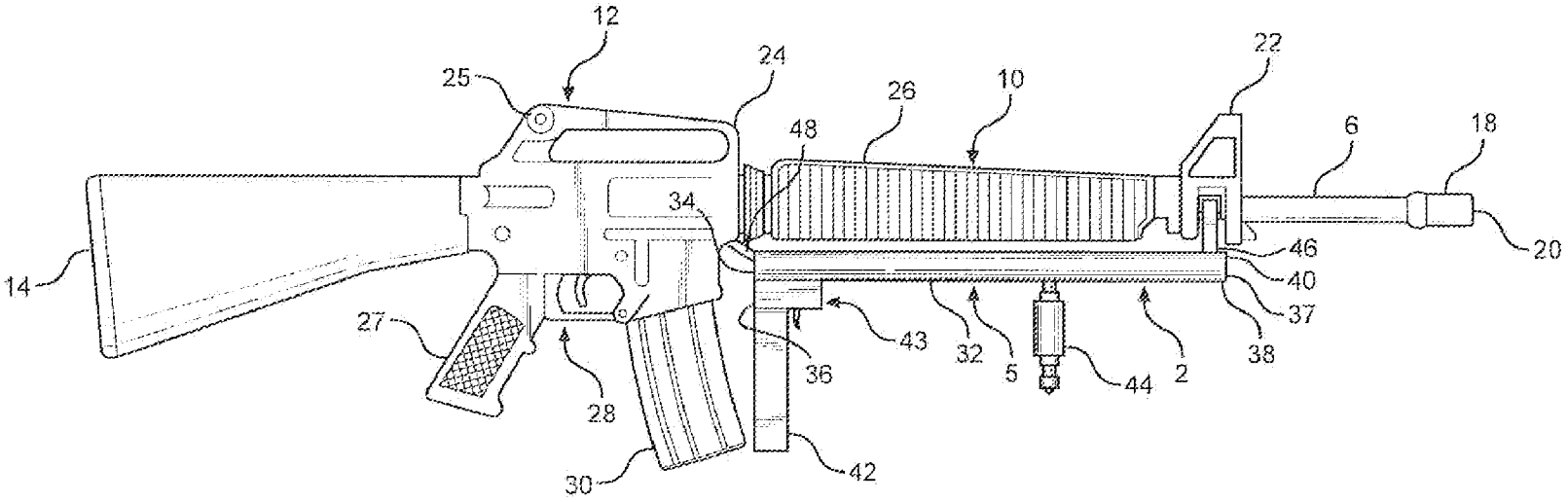
FIG. 1 is a side view of a magazine fed launcher constructed in accordance with the invention and attached to a rifle.

With initial reference to FIG. 1, there is shown a launching system 2 including a launcher 5 mounted under a barrel 6 of a rifle 10. However, launching system 2 can also be mounted to the side of barrel 6. Rifle 10 is preferably an M16 rifle or an M4 carbine equipped with Picatinny rails on the hand guards, but launching system 2 may be mounted to various types of military or civilian rifles. In any case, launching system 2 is preferably mounted so that it does not interfere with normal lethal operation of rifle 10 when fired or used with a bayonet (not shown).

As depicted, rifle 10 includes a central breech portion 12, a butt 14 extending rearward from breech portion 12 and a barrel 6 extending forwardly from central breech portion 12. Barrel 6 is provided with a flash arrester 18 mounted at its forward end 20. A forward sight 22 is mounted on barrel 6 and set back from forward end 20. A transport handle 24 includes a rear sight 25 and is mounted on central breech portion 12. A hand guard 26 extends along barrel 6 from breech portion 12 to forward sight 22. A grip 27 extends downward from central breech portion 12 and is located adjacent a trigger assembly 28. A magazine 30 extends downward from central breech portion 12 and is located just forward of trigger assembly 28. At this point, it should be noted that the details of the operation and construction of rifle 10 are not part of the invention. Therefore, the above description has been provided for the sake of completeness, but further description regarding rifle 10 can be found in U.S. Pat. No. 6,134,823, incorporated herein by reference. Instead, the invention is more particularly directed to launching system 2, how launching system 2 may be mounted to rifle 10 and the projectiles employed with launching system 2 as will be described in detail below.

As shown in FIG. 1, launcher 5 includes a barrel 32 with a breech 34 at a rear end 36 and a bore 37 leading to a muzzle 38 at a front end 40. A magazine 42 extends downward from breech 34. Barrel 32 is preferably made of a lightweight material, such as plastic. A trigger assembly 43 is located just forward of magazine 42. An adjustable and removable tactical handle 44 extends from barrel 32 at a point between trigger assembly 43 and muzzle 38. In the embodiment shown, launcher system 2 is connected to rifle 10 at two points. More specifically, front end 40 of launcher 5 is shown attached to barrel 6 of rifle 10 near forward sight 22 by a clamp bracket 46, while rear end 36 of launcher 5 is attached to breech portion 12 by a connector bracket 48. In the preferred embodiment, launcher 5 is used on a parent weapon equipped with Picatinny rails for mounting accessories along barrel 6. The Picatinny mount on launcher system 2 is articulated to allow regulation of fire to parent weapon's site 25, 22. The Picatinny rail system allows launchers to be attached on either side of barrel 6 or under barrel 6. If mounted on the side of barrel 6, launcher system 2 would not interfere with the standard vertical grip or the bayonet (not shown).

Figure 2:
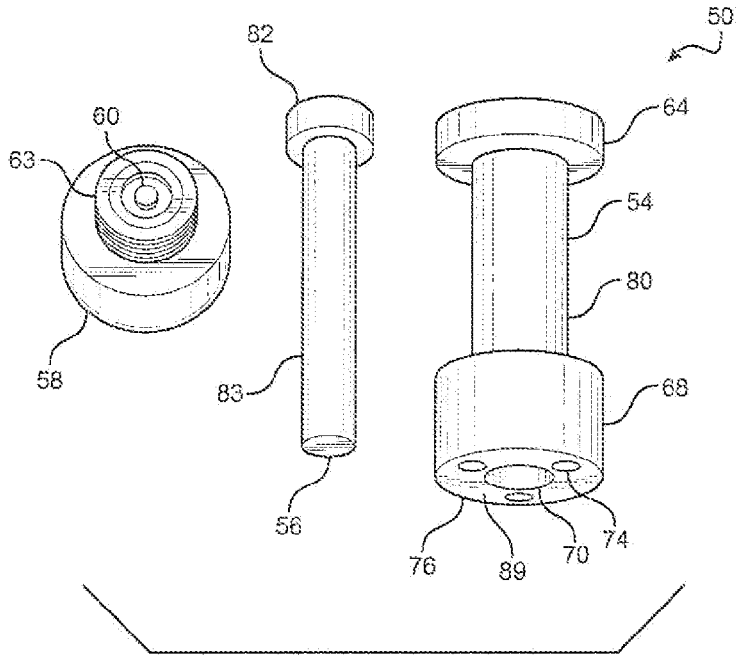
FIG. 2 is an exploded view of a projectile in accordance with a first preferred embodiment of the invention.

Turning now to FIG. 2 there is shown an exploded view of a projectile 50 designed to be fired mechanically from launcher 5 in accordance with a first preferred embodiment. Projectile 50 includes, as main components, a main body 54, a piston 56, a cylindrical cavity inside of nose 58 contains charge 60 including a primer and a gas-generating solid propellant, and an ogive or blunt dome-shaped nose 58 having a threaded portion 63 threadably secured to a front end 64 of body 54. As shown, threaded portion is hollow and receives charge 60 therein. Body 54 also includes front end portion 64, an enlarged diameter base portion 68 with a central piston hole 70 and three vent holes, one of which is labeled with reference numeral 74, at a rear surface 89 of end 76. A central connecting portion 80 connects front end portion 64 to enlarged diameter base portion 68. Preferably, piston 56 has an enlarged diameter piston head 82 and an elongated rod or shaft 83.

Figure 3:
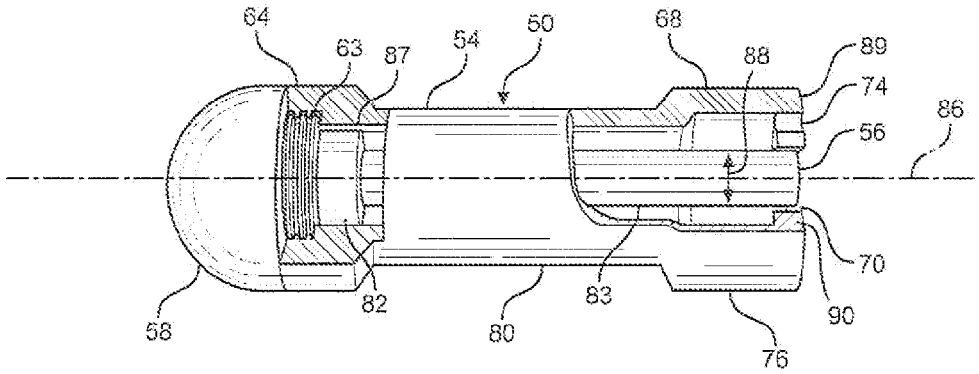
FIG. 3 shows a partially cut away perspective view of the projectile of FIG. 2 in an assembled configuration and having a piston in a retracted position.

FIG. 3 shows projectile 50 in a fully assembled configuration as projectile 50 is arranged just prior to firing. When assembled, piston 56 is located inside and along an axial centerline 86 of projectile body 54. Enlarged diameter piston head 82 is slightly smaller than an inside diameter 87 of projectile body 54 such that the arrangement allows piston 56 to slide relative to body 54. Hole 70 is just slightly larger than a diameter 88 of shaft 83 of piston 56, while also being smaller in diameter than enlarged diameter head 82 of piston 56. Just prior to firing, enlarged diameter piston head 82 is located just rearward of ogive-shaped nose 58, adjacent primer and propellant housing with charge 60, while elongated shaft 83 of piston 56 extends within central piston hole 70 in base portion 68 of projectile 50. In this manner, a terminal end (not labeled) of elongated shaft 83 is substantially flush with surface 89 of rear end 76 of projectile base portion 68 as clearly shown in this figure.

Figure 4:
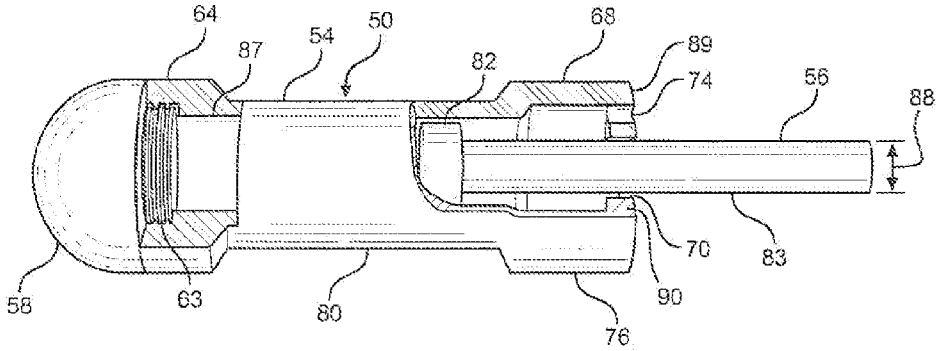
FIG. 4 shows a partially cut away perspective view of the projectile of FIG. 2 with the piston in a partially extended position.
Figure 5:
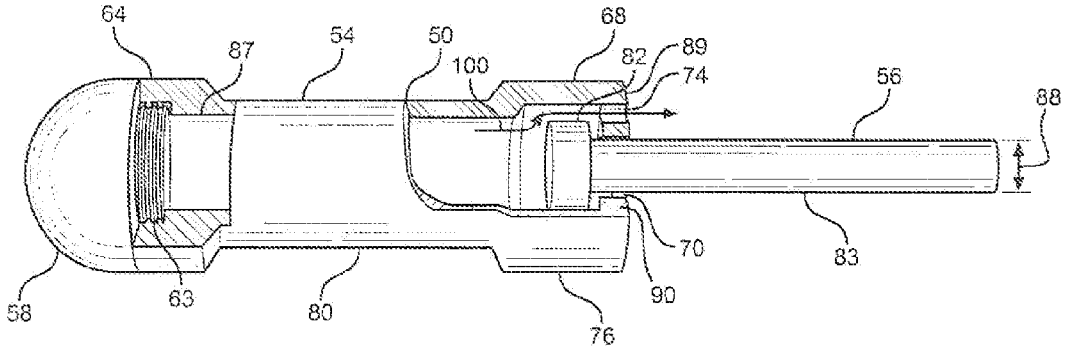
FIG. 5 shows a partially cut away perspective view of the projectile of FIG. 2 with the piston in a fully extended position.

As best seen in FIGS. 3-5, enlarged piston head 82 is movable within projectile body 54 from just behind the cylindrical cavity containing charge 60 towards base portion 68 of projectile body 54, which results in elongated shaft 83 extending or telescoping from rear end 76 of projectile 50. Piston 56 is shown partially extended in FIG. 4 and substantially fully extended in FIG. 5. Because enlarged piston head 82 is larger than central piston hole 70, piston head 82, in the fully extended position, abuts an inner radial rear wall 90 of base portion 68, thus retaining piston head 82 within projectile 50. Furthermore, ogive-shaped nose 58 is threadably or otherwise secured to front end 64 and also retains piston 56. As such, piston 56 is captive and cannot be completely removed from projectile 50.

Figure 6A:
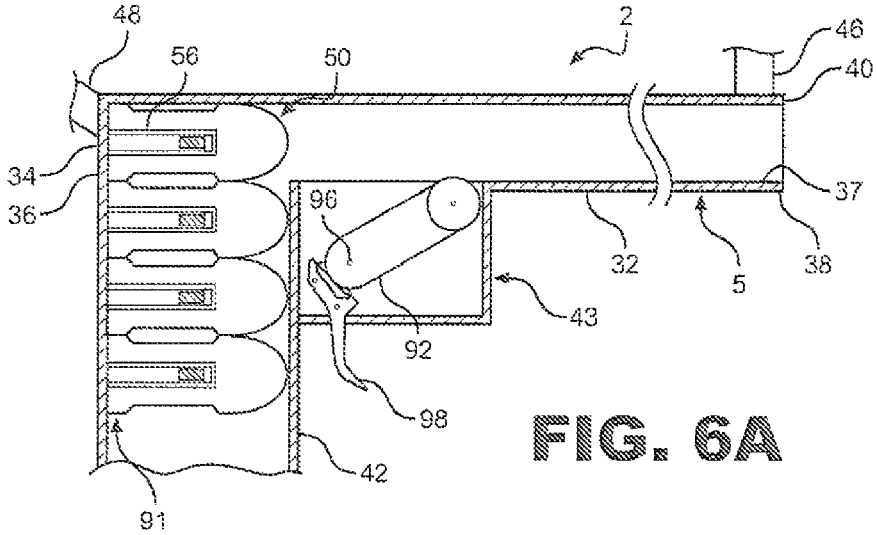
FIG. 6A is a cross sectional view showing operation of a mechanically operated launcher in a first stage of an operating cycle according to the first preferred embodiment of the invention.
Figure 6B:
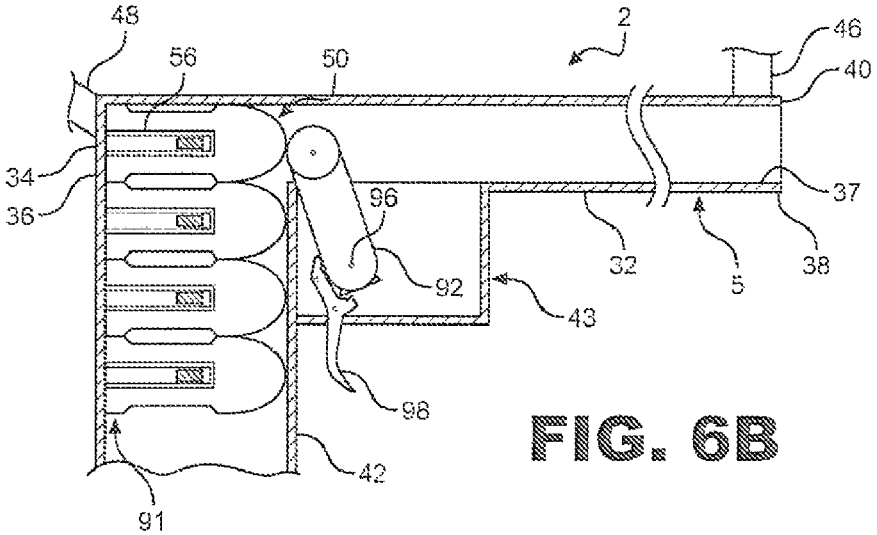
FIG. 6B is a cross sectional view showing operation of the mechanically operated launcher in a second stage of an operating cycle according to the first preferred embodiment of the invention.
Figure 6C:
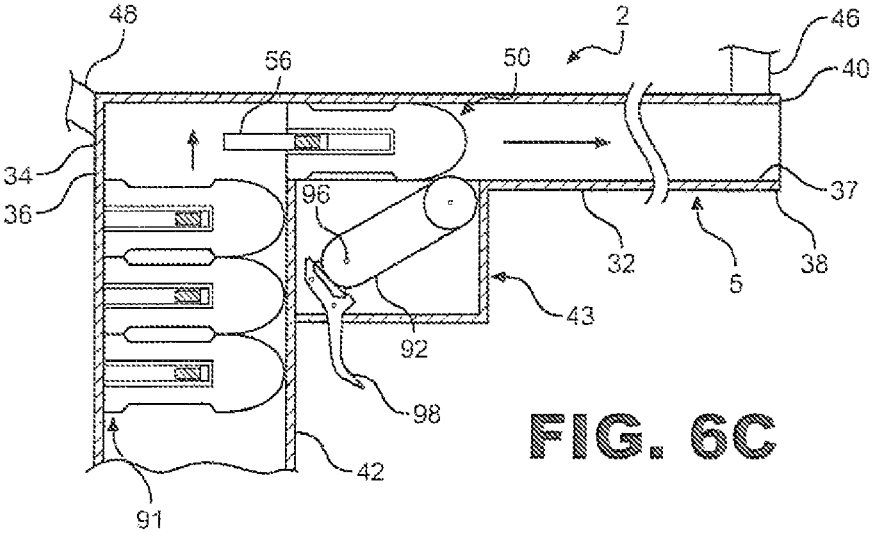
FIG. 6C is a cross sectional view showing operation of the mechanically operated launcher in a third stage of an operating cycle according to the first preferred embodiment of the invention.

Turning now to FIGS. 6A, 6B and 6C in order to show the details of operation in the mechanical mode, a cross section of launcher system 2 is depicted at three different times in a firing cycle. In FIG. 6A, launcher system 2 is shown with trigger assembly 43 in cocked or ready position, while projectile 50 is located in barrel 32 near breech 34. Magazine 42 is attached to barrel 32 and designed to contain numerous additional projectiles 91. Trigger assembly 43 includes a hammer mechanism 92 which is mounted for pivotal movement about an axis indicated at 96 and is biased for movement in a counterclockwise direction by a torsion or other spring (not shown). Trigger assembly 43 also includes a pivotally mounted trigger 98 in engagement with hammer mechanism 92. As depicted in FIG. 6A, hammer mechanism 92 and trigger 98 are located in a ready position spaced from projectile 50, with trigger 98 preventing hammer mechanism 92 from rotating.

In operation, projectile 50 is placed within launcher 5 with base portion 68 of projectile 50 set against breech 34 of launcher 5. Projectile 50 is aligned with bore 37 and faces muzzle 38. When trigger 98 is pulled, hammer mechanism 92 is released and forcibly rotates into engagement with projectile 50, as shown in FIG. 6B. The action of hammer mechanism 92 hitting projectile 50 initiates the primer and charge 60 located in the cylindrical cavity in nose 58, which rapidly generates hot gas acting on piston 56, forcing piston head 82 to move away from ogive-shaped nose 58. At this point, shaft 83 of piston 56 extends through hole 70, abuts breech 34 and pushes against breech 34 of launcher 5, thereby forcing projectile body 54 to rapidly accelerate toward muzzle 38 of launcher 5. Preferably, barrel 32 is rifled to allow spin stabilization of projectile 50. When projectile 50 travels a distance equal to the length of elongated shaft 83 minus the thickness of wall 90 in base 68, enlarged piston head 82 abuts rear wall 90 such that there is no longer any relative motion between piston 56 and projectile body 54. Also, hammer mechanism 92 is automatically pushed back to a cocked position by projectile 50 so as to be ready to fire again when another of additional projectiles 91 is aligned with barrel 32.

At this point in operation, projectile 50 has sufficient momentum to continue with its fully extended piston 56 towards front end 40 of barrel 32 as represented in FIG. 6C. Also, vent holes 74 located in base 68 of projectile 50 become fluidly connected to the hot gas located in front of piston 56 and thus the hot gas may travel around enlarged piston head 82 as shown by arrows 100 in FIG. 5. The hot gases exit main body 54 by being expelled through vent holes 74, thus creating a supplemental acceleration or at least reducing drag resulting in longer projectile ranges and safely discharge the pressure contained in the projectile. The burning primer and propellant work more efficiently and increase the pressure of hot gas more rapidly when the gas is initially trapped behind piston head 82 and then exits vent holes 74 only after piston 56 is fully extended than compared to a conventional rocket or other projectile without a piston. Preferably, burning charge 60 includes delaying ignition of some of charge 60 until after projectile 50 has left barrel 32.

Once projectile 50 has been launched, no casing is left in barrel 32. With no casing left in barrel 32 that must be ejected, reloading an additional projectile 91 becomes relatively easy and magazine 42 simply pushes an addition projectile into firing position preferably under the influence of a spring (not shown). In addition, since the hot gas is not trapped in barrel 32 but rather expands within projectile 50, barrel 32 may be made of relatively light material. Furthermore, the captive piston arrangement, in the absence of bypass venting also advantageously eliminates muzzle flash and the acoustic signal normally associated with propellant powered projectiles, however the absence of bypass venting results in a lower launch velocity for a given length of piston travel in the bore.

When launching system 2 is used in a non-lethal mode, the acceleration caused by piston 56 bearing against breech 34 is the predominate source of projectile kinetic energy. The force from the gas escaping from vent holes 74 serves only to add a small amount of kinetic energy and provides thrust in flight to maintain flight velocity against retardation caused by aerodynamic drag. However, when launching system 2 is used in a lethal mode, the jet of hot gas that escapes from vent holes 74 in base 68 of projectile 50 after piston 56 is fully extended produces the predominant acceleration of projectile 50. The difference between the two modes is primarily the type of and mass of the propellant charge used. Basically, in the non-lethal mode, the mass of the propellant is smaller than in the lethal mode. For the non-lethal projectile, there is a small mass of propellant and the burn rate decrease with time to produce a small steady thrust in flight. For the lethal projectile, the mass of the propellant is large and the burn rate is progressive to maintain large thrust and continued acceleration as projectile 50 moves away from breech 34 and eventually moves away from muzzle 38 of launcher 5 towards its target (not shown). For a non-lethal fire, the design impact velocity is preferably less than or equal to 300 ft/sec, while nose 58 of projectile 50 is blunt and may be compliant to minimize the likelihood of penetration into a target. For the lethal embodiment, the impact velocity is made greater than or equal to 800 ft/sec, while nose 58 of projectile 50 is preferably sharp and of a non-compliant material to enhance penetration.

Figure 7:
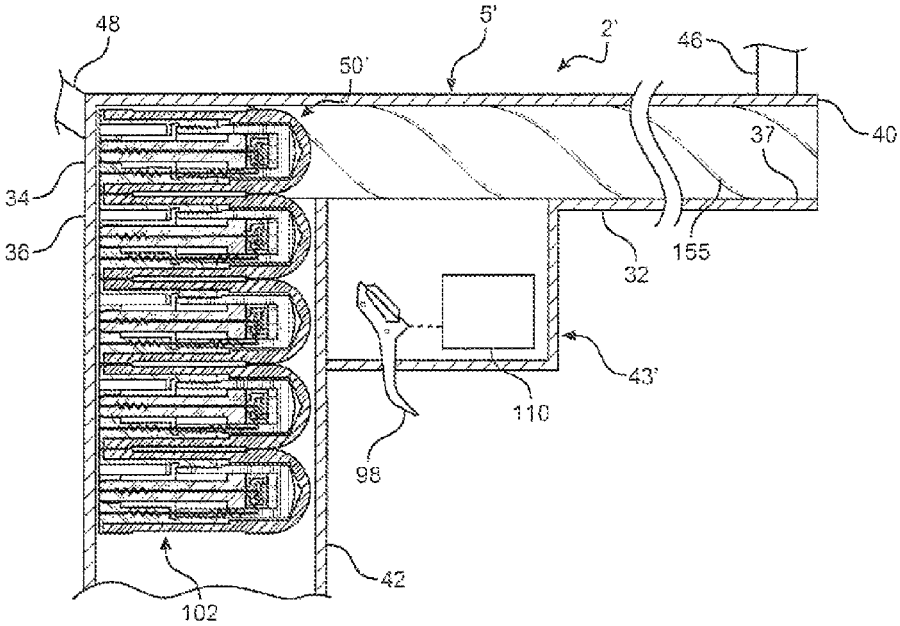
FIG. 7 is schematic view showing an electrically operated launcher according to a second preferred embodiment of the invention.
Figure 8:
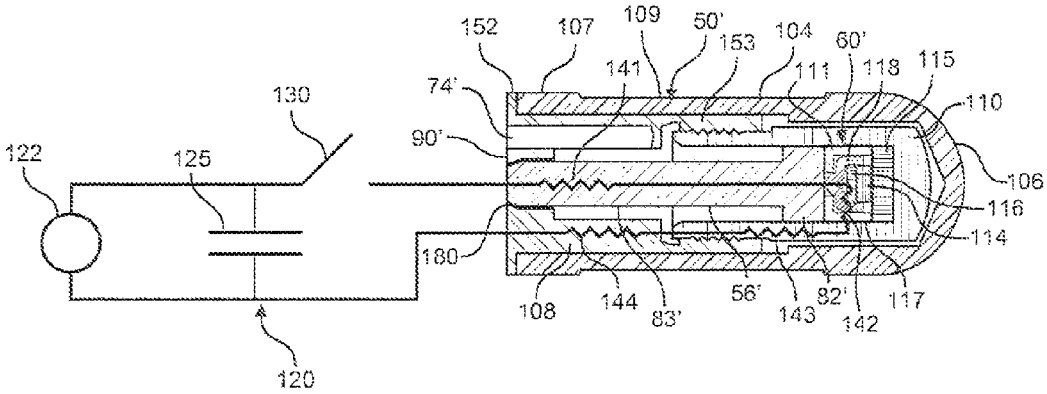
FIG. 8 is an enlarged schematic view of one of the fully assembled projectiles of FIG. 7 shown with a piston in the fully retracted position.

FIGS. 7 and 8 show a second preferred embodiment of the invention wherein an electric current is used to initiate a gas-generating solid propellant inside projectile 50'. Several parts of the second embodiment are the same as the first embodiment and are therefore represented by common reference numerals. As depicted in FIG. 7, several electrically activated projectiles 102 are mounted in launcher 5' with one projectile 50' in firing position in barrel 32. As best shown in FIG. 8, projectile 50', which preferably has an overall length of about 1.25 inches (approximately 3.2 cm) long with a diameter of 0.506 inches (approximately 12.85 cm) and weighs approximately 8 grams, includes a hollow outer body 104, preferably formed of Noryl, but which can be made from any suitable high-strength polymer, which includes a front ogive-shaped nosepiece 106 and an open trailing or rear portion 107. A base sleeve 108, preferably made of aluminum, is positioned within rear portion 107. Also shown in FIG. 8 a decreased diameter section 109 of projectile body 104 between nosepiece 106, and the rear portion 107. Using decreased diameter section 109 reduces the "in bore" friction which helps to keep the velocity high, results in less shot-to-shot velocity variation and also better centers projectile 50' in bore 37.

Located within outer body 104 is an internal combustion housing 110 which extends near nosepiece 106 and contains a charge 60' which includes an electrically initiated primer 111 and an amount of gas-generating solid propellant 115 as discussed further herein. The details of primer 111 are not part of the invention. Preferably, primer 111 is made of an electrically conductive material such as a brass electrode 116, with an electrically conductive explosive 114 pressed into a cup 117. Electrically conductive electrode 116 is fitted between explosive 114 and the bottom of cup 117. Insulating polymer 118 is used to isolate electrically conductive electrode 116 from electrically conductive cup 117. In any case, the details of primer can be found in U.S. Pat. No. 6,131,515, incorporated herein by reference. Alternatively, primer 111 is replaced with a reactive semiconductor bridge.

A firing circuit 120 includes a source of electrical voltage 122, such as a battery and voltage increasing circuit, a charging capacitor 125 and several portions of projectile 50', each of which acts as a resistor. More specifically, piston 56', which has an electrically insulating oxide coating on its exterior surfaces in contact with base 108 and combustion chamber 110 and primer cup 117, acts as a first resistor 141, primer 111 located in the cavity acts as a second resistor 142, combustion housing 110 acts as a third resistor 143 and aluminum base sleeve 108 acts as a forth resistor 144. This conductive path allows launcher 5' and projectile 50' to be an active part of firing circuit 120. When capacitor 125 in circuit 120 is charged, preferably to approximately 1.0 microfarad at 150 volts, capacitor 125 is short circuited across primer 111 of charge 60', causing a current to pass through explosive 114 causing detonation. The combination of fixed open breech 34 with electric ignition from circuit 120 permits very rapid rates of fire that may be in excess of 100 Hertz. Such rapid rates of fire can be used to vary the terminal effect from a single impact to multiple near simultaneous impacts. The synergistic effect of multiple near simultaneous impacts will be greater than multiple impacts over a longer time period. Multiple near simultaneous impacts will also be better at defeating simple counter measures such as padded clothing, because the first impact will compress the padding, decreasing its ability to dissipate the energy of the following impact or impacts. The electronic firing circuit 120 is preferably designed to select single or multiple shots per firing cycle.

Preferably, propellant 115 is also present, such as in the order of 45 mg, between primer 111 and the front of combustion chamber 110. Aluminum base sleeve 108 has an outer flange 152 that engages, preferably through a press-fit attachment, with outer body 104 and an inner flange 153 that is threadably connected to chamber 110 at 153 to encapsulate piston 56' in projectile 50'. As also clearly shown, base 108 is formed with an inner radial rear wall 90' provided with vent holes 74'. More details of base 108 are set forth below in the description of FIGS. 11 and 12.

Figure 9:
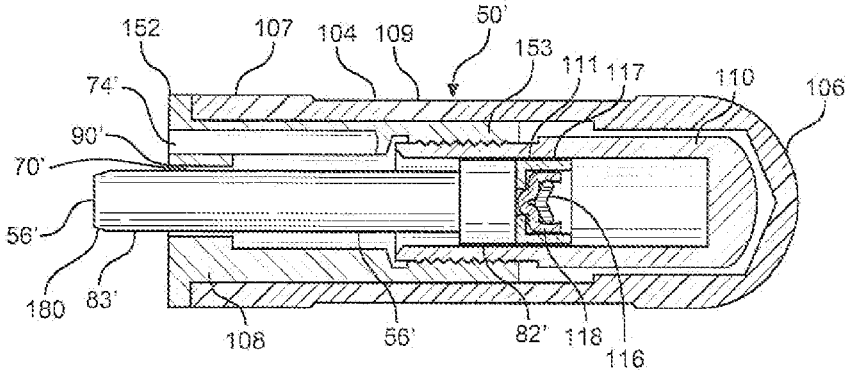
FIG. 9 shows a partially cut-away view of the projectile of FIG. 8 shown with the piston in a partially extended position.
Figure 10:
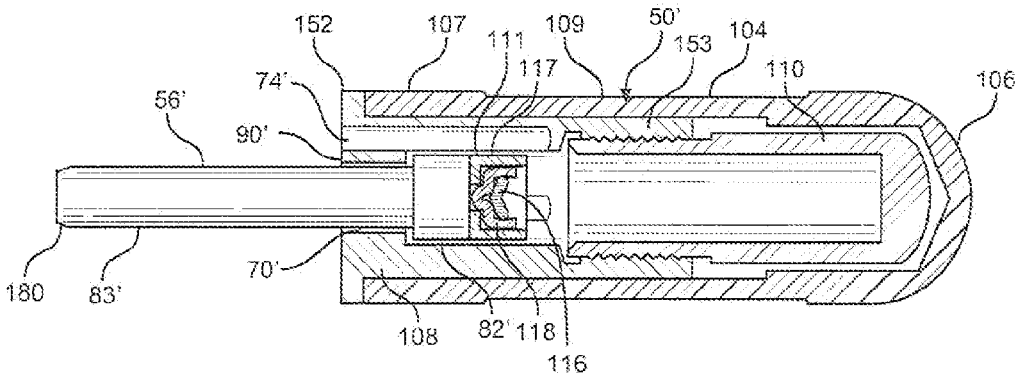
FIG. 10 shows a partially cut-away view of the projectile of FIG. 8 shown with the piston in a fully extended position.

The operation of projectile 50' in the second preferred embodiment is similar to the operation of projectile 50 in the first preferred embodiment with the exception of how the primer is initiated. Turning now to FIGS. 8-10, the projectile 50' is shown at difference times in a firing cycle. FIG. 8 shows projectile 50' before firing, such as when located in launcher 5' as shown in FIG. 7. Pulling trigger 98 causes circuit 120 to go through a firing cycle and thus initiate the primer which, in turn, ignites propellant 115 and generates hot gas against the primer which bears directly against enlarged diameter piston head 82'. As with the first embodiment, elongated shaft base 83' of piston 56' extends out of a hole 70' to push against breech 34 until shaft 83' reaches its fully extended position as represented in FIG. 10. Once again, in the fully extended position, hot gas may escape around piston head 82' and escape through vents 74' to provide additional acceleration and safely discharge pressure from within projectile 50' and launcher 5' may be used with lethal or non-lethal projectiles as described with reference to the first embodiment.

Preferably, propellant 115 is a relatively slow burning propellant. Faster propellants produce higher pressures that may deform piston 56' due to the rapid rise in force against breech 34. Preferably, a charge of 50 mg of a slower burning propellant, such as Hodgdon HS-6 ball propellant, is used. Slower burning propellants, such as Alliant Blue Dot, a shot gun powder, may be used but they are considered less desirable because they allow for un-burnt powder being ejected from combustion chamber 110 and un-burnt propellant flakes still contained inside combustion chamber 110. The intermediate burn rate Hodgdon HS-6 shows no evidence of incomplete combustion and produces consistent velocity. Also barrel 32 is preferably provided with rifling 155 to allow spin stabilization of projectile 50'. Propellant 115 may also be of a decomposing compound such as, but not limited to, sodium azide which rapidly produces gas when initiated. Sorting primers 111 into groups that have a mass range of 1 mg or less also results in greater accuracy when projectiles are fired. Without sorting primers 111 some projectiles will fire with a velocity significantly lower than others. For example, the mass of 100 individual primers was weighed to 0.1 mg on an analytical balance. The average mass of the primers was 313.8 mg and the range of masses was 308.8 to 318.7 mg. Fourteen primers were carefully disassembled, the energetic material removed and the components washed and dried. The average mass of the primer components, less the energetic material, was 280.3 mg. By subtraction the average mass of energetic material is 33.5 mg per primer. The large range in primer mass of 9.9 mg is likely due to variations in the mass of the energetic material. This variation in energetic material is 30% of the total primer energetic mass and 12% of the total energetic mass (including propellant 115). This large variation in energy content is likely responsible for large projectile velocity variations observed before sorting the primers by mass.

Figure 11:
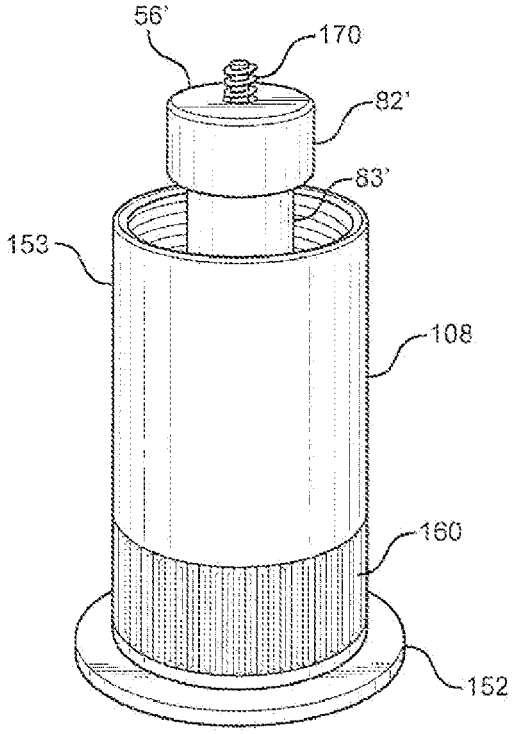
FIG. 11 shows a perspective view of a base sleeve of the projectile shown in FIG. 8, showing an external straight knurl.
Figure 12:
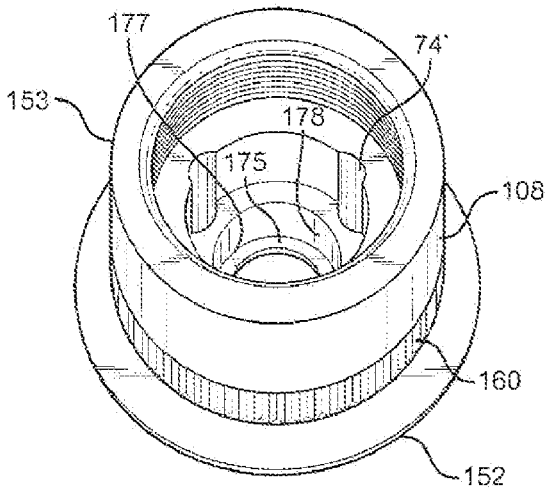
FIG. 12 shows a perspective view of the base sleeve of FIG. 11, with the piston removed, showing an internal shear flange on a piston shaft guide and the vents.

FIGS. 11 and 12 show a more detailed perspective view of base 108 of projectile 50' shown in FIG. 8, showing an external straight knurl 160 and an internal shear flange 175 on a piston shaft guide 178. As best seen in FIG. 11, piston 56' includes a spring 170 used for electrical contact to primer 111. Straight knurl 160 is a raised knife edged corrugation on the exterior surface of projectile base 108 that preferably extends in a longitudinal direction. Straight knurl 160 creates a mechanical binding between outer body 104 and projectile base 108 and more effectively transmits torque from rifling on bore 37 of barrel 32, through rear portion 107 of outer body 104 to the interior components of projectile 50'.

Straight knurl 160 prevents outer body 104 from rotating at a different rate than sleeve 108 and combustion chamber 110 and thus prevents an unstable projectile that tumbles in flight. This phenomenon of slippage has been observed in artillery projectiles that have driving bands to transfer torque from rifling to a projectile body. Straight knurl 160 also expands outer body 104, as can best be seen in FIG. 8, which results in greater engagement with rifling 155. Rifling 155 is shown as being on a thin steel sleeve liner placed inside plastic barrel 32 but rifling 155 may also be formed directly in barrel 32. Alternatively base 108 may be located in projectile 50' using insert injection molding. Manufacture using insert injection molding will allow for an integral bonding of projectile polymer outer body 104 to sleeve 108 to which angular torque is applied from the angular acceleration imparted by rifling 155 in bore 37. Integral bonding of these two components will insure that there is no relative motion between the two components during projectile acceleration and they rotate about the axial centerline of projectile 50' in unison. Outer body 104 is preferably bonded to base sleeve 108 of projectile 50', in which case combustion chamber 110 is threadably attached to base sleeve 108 using a right hand thread (for right handed rifling). Alternatively, combustion chamber 110 is integrally bound to outer body 104, in which case base sleeve 108 will be threadably attached to combustion chamber 110 using a left handed thread (for the case of right handed rifling). The directionality of thread 153 joining combustion chamber 110 and base sleeve 108 is selected so that the torque applied by the angular acceleration causes tightening of the threadably connected components. Insert molding allows for a smaller metallic mass to be used in base sleeve 108 because polymer outer body 104 contributes to the mechanical properties of projectile 50'. Thus, the overall mass of projectile 50' can be decreased or more mass can be placed in nose piece 106. For example, a chemical marker or irritant that is released upon impact may be added to projectile 50'. In either case, the center of mass will be moved forward, thereby decreasing the amount of spin required for gyroscopic stability.

Preferably, the diameter of flange 152 on aluminum base 108 should be large enough to engage rifling 155 to ensure that aluminum base 108 and outer body 104 rotate in unison when traveling down bore 37 and during their ballistic travel to the target. The increased diameter, preferably 0.506 inches, also scrapes barrel 32 clean, resulting in little to no visible build-up of plastic or powder fouling in bore 37.

A spring 170 in head 82' of piston 56' provides positive electrical contact to primer 111 and prevents poor electrical contact between piston head 82' and primer 111. Preferably, a 0.059 inch hole is drilled 0.085 inches deep in the center of head 82' of piston 56'. Into this hole is inserted a small spring 170 preferably with an outside diameter of 0.057 inches and a length of 0.120 inches. Using spring 170 increases the reliability of ignition.

As shown in FIG. 12, a machined, tapered flange 175 is preferably formed on an inside bottom edge 177 of piston shaft guide 178. Flange 175 mates with a matching taper 180 best seen in FIGS. 8, 9 and 10 and located on shaft 83' of piston 56' and holds piston head 82' pressed against primer 111. Upon firing, tapered flange 175 is sheared by the action of piston 56' extending out from base piece 108. Tapered flange 175 also results in an improvement in accuracy by making the initial conditions of the propellant ignition more consistent. The greater consistency comes from flange 175 holding piston 56' against primer 111, thereby providing a more uniform initial resistance to the travel of piston 56' and the expansion of the propellant gas. By analogy, flange 175 acts like the crimp on a conventional rifle cartridge. The crimp on a conventional rifle cartridge controls the uniformity of the "bullet pull" which is the force to extract the bullet from the cartridge casing and has a significant effect on the internal ballistics.

Preferably there is a tight tolerance between the outer diameter of piston shaft 83' and the inner diameter of piston shaft guide 178 in base 108 of approximately 0.00075 inches of clearance. This helps to better support piston shaft 83' and keep it aligned with the axial center line of projectile 50' during firing. When the propellant charge is ignited, the pressure inside combustion chamber 110 rapidly rises and may go as high as 30,000 psi. At these high pressures, the force on piston head 82' approaches 1,000 pounds (pressure times the area of the piston head). This large force will cause piston 56' to buckle when compressed. The closer the fit the between piston shaft 83' and piston shaft guide 178 the better piston 56' is supported and the less piston 56' can buckle and bind from the compressive load imposed thereon.

The radial spacing of vents 74 in base 68 and vents 74' in base of sleeve 108 should be large enough so as to not bisect piston shaft guide 178. Spacing vents 74 on a large radius also helps to better support piston shaft 83' during firing. The preferred radial spacing of vents 74 also results in the orifice of each vent being larger and circular instead of quarter moon-shaped.

Figure 13:
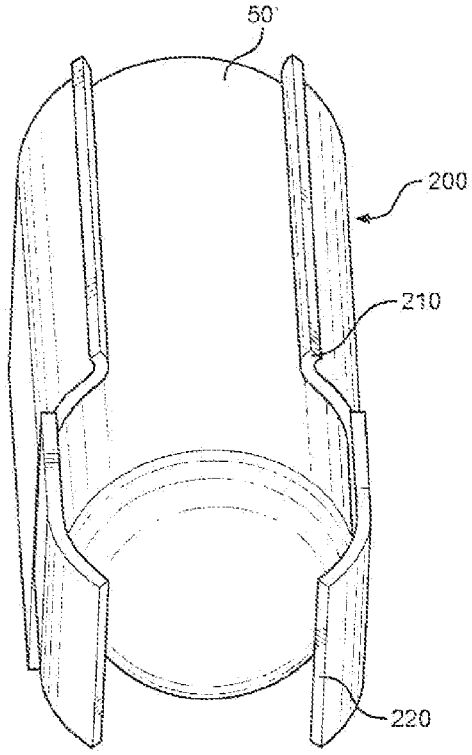
FIG. 13 shows a perspective view of a projectile located in a magazine in accordance with another embodiment of the invention.
Figure 14:
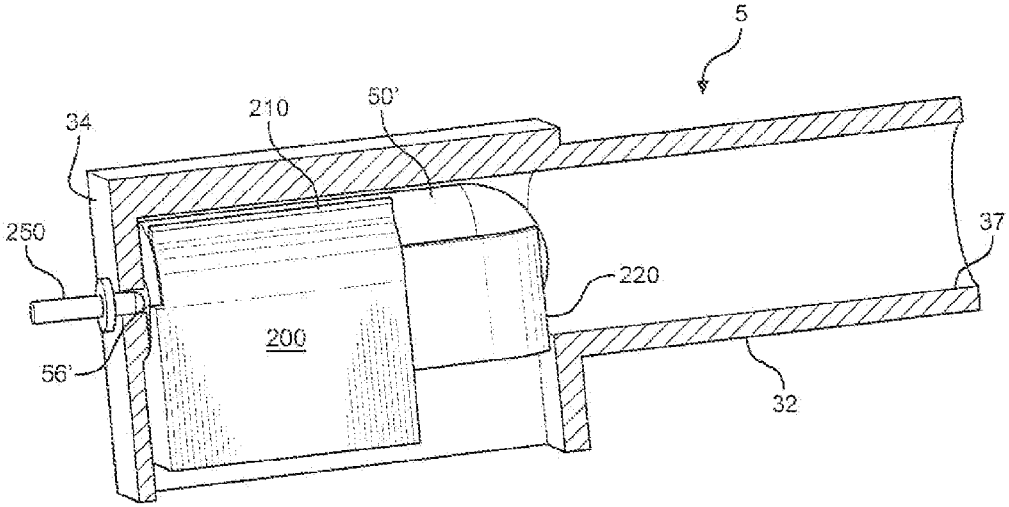
FIG. 14 shows the magazine of FIG. 13 located in a launcher.

FIGS. 13 and 14 show details of a magazine 200 according to another embodiment of the invention. Spring loaded top lips 210 located in the top of magazine 200 hold projectile 50' within magazine 200 when magazine 200 is removed from launcher 5. Top lips 200 also help to align magazine 200 so that projectile 50' is properly positioned relative to bore 37. Spring loaded front lips 220 are used to push projectile 50' against breech 34 of launcher 5. Spring loaded front lips 220 on nosepiece 106 are spread apart by the launching of projectile 50'. Spring loaded front lips 220 ensure that piston 56' is pressed against breech 34 prior to firing and that there is no free travel of piston 56' prior to contact with breech 34. Free travel of piston 56' prior to contact with breech 34 results in variations in launch velocity because the initial interior ballistics are affected when piston 56' is not restrained from motion by the inertial mass of projectile 50'. Free travel of piston 56' results in high velocity impacts on breech 34 and deformation of the base of piston 56'. The deformation of piston 56' reduces the energy imparted to projectile 50'. Also when piston 56' is pressed against breech 34, a sliding electrode 250 forms a proper electrical contact with piston 56'. Therefore, electrode 250 forms part of firing circuit 120 shown in FIG. 8.

The accuracy of a launcher 5' has been measured experimentally to determine how closely the fired projectile's impact to the aiming point on the target. The accuracy of the weapon is influenced by the precision (how closely together each fired rounds impacts to the others when aimed at the same spot) of the weapon/ammunition combination, the trajectory, the time of flight, and environmental influences such as wind. Typically, it is the precision of a weapon/ammunition combination that is measured. Several methods of measuring and recording the dispersion of projectile impacts, when the gun is aimed at the same spot, are used. The Department of Defense (DOD) tends to report group sizes as a mean radius from the geometric center of the group. In the non-DOD market, group size is often reported as the extreme center-to-center spread of the group or as the diameter of the smallest circle that can completely cover the group. Lastly, some ballistic laboratories report group size as standard deviation along the X and Y axis of the impact locations relative to the center of the group.

For launcher 5, we have reported the group by three methods: extreme spread; mean radius; and standard deviation (sigma) X and Y. Table 1 gives experimentally measured group sizes for 7, 9 and 10 shot groups fired at 30 yards using barrels of 18, 10 and 4.85 inches in length.

TABLE 1

Experimentally measured group sizes for projectiles fired from a launcher 5 on a fixed mount at range of 30 yards (all measurements relative to center of impact).

| Launcher | Range (yards) | # of Shots | Extreme spread (inch) | Mean Radius/ σ (inch) | $\sigma_x$ (inch) | $\sigma_y$ (inch) |
|---|---|---|---|---|---|---|
| 18 inch barrel open breech | 30 | 10 | 5.92 | 1.20/ 1.10 | 0.29 | 1.06 |
| 18 inch barrel open breech | 30 | 9 | 6.82 | 1.39/ 1.37 | 0.25 | 1.44 |
| 10 inch barrel open breech* | 30 | 7 | 6.56 | 1.78/ 1.2 | 0.38 | 1.37 |
| 10 inch barrel closed breech | 30 | 9 | 3.53 | 1.32/ 0.51 | 0.35 | .49 |
| 4.85 inch barrel closed breech | 30 | 7 | 6.46 | 2.16/ 1.09 | 0.72 | 1.02 |

*This group was fired before primers were sorted by mass. Two shots of the nine shots were not considered because they were significantly lower in velocity.

Based on the above, it should be readily apparent that the caseless launching system 2, 2' of the invention is advantageously lightweight, can be used with both lethal and non-lethal projectiles, and is small enough to be attached to a rifle without interfering with the main operation of the rifle. In any case, although described with reference to preferred embodiments of the invention, it should be readily understood that various changes and/or modifications could be made to the invention without departing from the spirit thereof. For instance, the launcher does not have to be used with a rifle and may be as a stand-alone weapon. Also, the projectile does not need to be 0.506" in diameter. Larger or smaller diameter projectiles are used to vary the impact effect. Furthermore, the light design enables the launcher to be carried hidden, for example in a policeman's baton. Also, instead of using a primer, a reactive semi-conductor bridge can be used to ignite the propellant. The ambient temperature affects the initial combustion rate of nitrocellulose based propellants. Higher ambient temperatures result in higher muzzle velocity for standard small and large arms. Lower ambient temperatures result in lower muzzle velocity. By design of the reactive semi-conductor bridge it can be possible to vary the energy output by varying the amount of electrical energy input into the reactive semi-conductor bridge. Thus the total energy imparted to the projectile could be varied to change the launch velocity or the energy output could be varied to compensate for ambient temperature. Also the use of the reactive semi-conductor bridge provides a uniform method of ignition. In general, the invention is only intended to be limited by the scope of the following claims.

We claim:

1. A launcher system for firing projectiles comprising:

a launcher including a barrel adapted to receive a projectile, a mechanism for activating the projectile and a magazine for storing additional projectiles; and a caseless projectile including:

a main body including a front end portion, a base portion and a connecting portion, said base portion having a piston hole and at least one vent hole positioned radially of the piston hole;

a piston, including a head and a shaft, slidably mounted within the main body for movement between a retracted position, wherein the head and shaft are located within the main body, and an extended position, wherein the shaft of the piston extends through the piston hole and extends out of the main body while the piston head is retained in the main body; and a charge provided in the main body whereby, when the mechanism activates the projectile and the charge is initiated, gases are created which force the piston to shift from the retracted position such that the shaft extends through the piston hole and engages the launcher to provide an initial thrust for the projectile within the barrel and, when the piston is in the extended position, the gases exit the main body through the at least one vent hole to provide additional thrust for the projectile.

2. The launcher system of claim 1, wherein the charge includes slow burning propellant that is present in an amount that primarily accelerates the projectile in the barrel to less than 300 feet per second whereby the projectile is a non-lethal projectile.

3. The launcher system of claim 2, wherein the main body includes a front wall that is shaped as a blunt dome, and a decreased diameter section, said main body being made of Noryl or other suitable high strength polymer.

4. The launcher system of claim 1, wherein the charge includes a slow burning propellant that is present in an amount that primarily accelerates the projectile after it leaves the barrel to greater than 800 feet per second, whereby the projectile is a lethal projectile.

5. The launcher system of claim 4, wherein the main body includes a front wall that is sharp and non-compliant.

6. The launcher system of claim 1, wherein the piston includes a tapered portion and the base portion includes a shear flange extending into the piston hole for engagement with the tapered portion to control propellant combustion, and an external straight knurl for engagement with the main body.

7. The launcher system of claim 1, wherein the at least one vent hole comprises multiple vent holes equally spaced around the piston hole, the main body is made from an injection moldable material with steel or aluminum inserts and the charge is shaped into a cylinder and mounted in the piston hole so that the piston slides within the cylinder.

8. The launcher system of claim 1, wherein the barrel is made from lightweight plastic with a thin steel liner that is rifled.

9. The launcher system of claim 1, further comprising: a bracket configured to attach the launcher to a conventional rifle.

10. The launcher system of claim 1, wherein the mechanism includes a trigger and the launcher further comprises: a hammer activated by the trigger, wherein the projectile further includes a primer located near a front wall of the main body and adjacent the charge whereby, when the trigger is pulled, the hammer hits the front wall of the projectile and causes ignition of the primer.

11. The launcher system of claim 1, wherein the mechanism includes a trigger and a firing circuit that is activated by the trigger and wherein the projectile further includes a primer located near a front wall of the main body whereby, when the trigger is pulled, the firing circuit causes ignition of the primer.

12. The launcher system of claim 11, wherein the firing circuit includes a spring electrode extending onto the primer.

13. A caseless projectile for use with a launcher system comprising:

a main body including a front end portion, a base portion and a connecting portion, said base portion having a piston hole and at least one vent hole positioned radially of the piston hole;

a piston, including a head and a shaft, slidably mounted within the main body for movement between a retracted position, wherein the head and shaft are located within the main body, and an extended position, wherein the shaft of the piston extends through the piston hole and projects out of the main body while the piston head is retained in the main body; and a charge provided in the main body whereby, when the charge is initiated, gases are created which force the piston to shift from the retracted position such that the shaft extends through the piston hole and to provide an initial thrust for the projectile and, when the piston is in the extended position, the gases exit the main body through the at least one vent hole to provide additional thrust for the projectile.

14. The projectile of claim 13, wherein the charge includes slow burning propellant that is present in an amount that primarily accelerates the projectile in a barrel of the launcher to less than 300 feet per second whereby the projectile is a non-lethal projectile.

15. The projectile of claim 14, wherein the main body includes a front wall that is shaped as a blunt dome, and a decreased diameter section and is made of Noryl or other suitable high-strength polymer.

16. The projectile of claim 13, wherein the charge includes slow burning propellant that is present in an amount that primarily accelerates the projectile after it leaves a barrel of the launcher to greater than 800 feet per second, whereby the projectile is a lethal projectile.

17. The projectile of claim 16, wherein the main body includes a front wall that is sharp and non-compliant.

18. The projectile of claim 13, wherein the at least one vent hole comprises multiple vent holes spaced around the piston hole, the main body is made from an injection moldable material with steel or aluminum inserts and the charge is shaped into a cylinder and mounted in the piston hole so that the piston slides within the propellant shaped into a cylinder.

19. The projectile of claim 13, wherein the piston includes a tapered portion and the base portion includes a shear flange extending into the piston hole for engagement with the tapered portion, and an external straight knurl for engagement with the main body.

20. A method of firing a projectile from a launcher comprising:

initiating a charge provided in a main body of a caseless projectile;

forcing a piston, having a head and a shaft slidably mounted in the main body of the projectile, to shift, from a retracted position, relative to the main body such that the shaft extends out a through hole of the main body and engages the launcher to provide an initial thrust for the projectile;

causing continued relative shifting between the piston and the main body until the piston reaches an extended position wherein the shaft projects from the main body but the head is retained within the main body; and venting charge gases through at least one vent hole after the piston reaches the fully extended position to provide additional thrust for the projectile and safely discharge pressure retained in the projectile.

21. The method of claim 20, further comprising: accelerating the projectile to less than 300 feet per second so that the projectile impacts a target with non-lethal force.

22. The method of claim 20, further comprising: accelerating the projectile to at least 800 feet per second so that the projectile is able to impact a target with deadly force.

23. The method of claim 20, wherein burning the charge includes delaying ignition of some of the charge until after the projectile leaves the launcher.

24. The method of claim 20, wherein initiating the charge includes striking the projectile with a hammer to cause the piston to impact to a priming compound that initiates the charge.

25. The method of claim 20, wherein initiating the charge includes forming an electric current that ignites a priming compound to initiate the charge.

* * * * *